United States Patent [19]

Kraft

[11] 4,130,192

[45] Dec. 19, 1978

[54] TRANSPORTATION APPARATUS

[75] Inventor: Joseph K. Kraft, Dover, N.J.

[73] Assignee: Westinghouse Electric Corp., Pittsburgh, Pa.

[21] Appl. No.: 748,247

[22] Filed: Dec. 6, 1976

[51] Int. Cl.[2] ..... B66B 9/12

[52] U.S. Cl. ..... 198/327; 198/838

[58] Field of Search ..... 198/326, 327, 328, 329, 198/330, 331, 332, 333, 838; 104/25, 130

[56] References Cited

U.S. PATENT DOCUMENTS

| | | | |
|---|---|---|---|
| 899,933 | 9/1908 | Wheeler | 198/332 X |
| 984,304 | 2/1911 | Seeberger | 198/329 |
| 2,649,181 | 8/1953 | Hansen | 198/329 |
| 3,297,127 | 1/1967 | Dennerlein | 198/330 X |
| 3,365,051 | 1/1968 | Mullis et al. | 198/330 X |

*Primary Examiner*—Evon C. Blunk
*Assistant Examiner*—Douglas D. Watts
*Attorney, Agent, or Firm*—D. R. Lackey

[57] ABSTRACT

Transportation apparatus including an endless belt having platforms, pallets or steps attached thereto. The endless belt is driven in a guided loop through load bearing and return runs interconnected by turn-arounds at the ends of the loop. Guide rollers and guide tracks cooperate to guide the endless belt, with the guide tracks associated with the load bearing and return runs being connected in the turn-arounds via dynamic transition apparatus including cooperative guide track structure which enables normal manufacturing and assembly tolerances to be observed while automatically compensating for wear. The apparatus constantly seeks the best adjustment mode, providing smooth operation with minimal noise and vibration.

10 Claims, 15 Drawing Figures

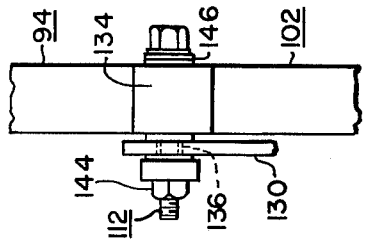
FIG. 9
FIG. 8
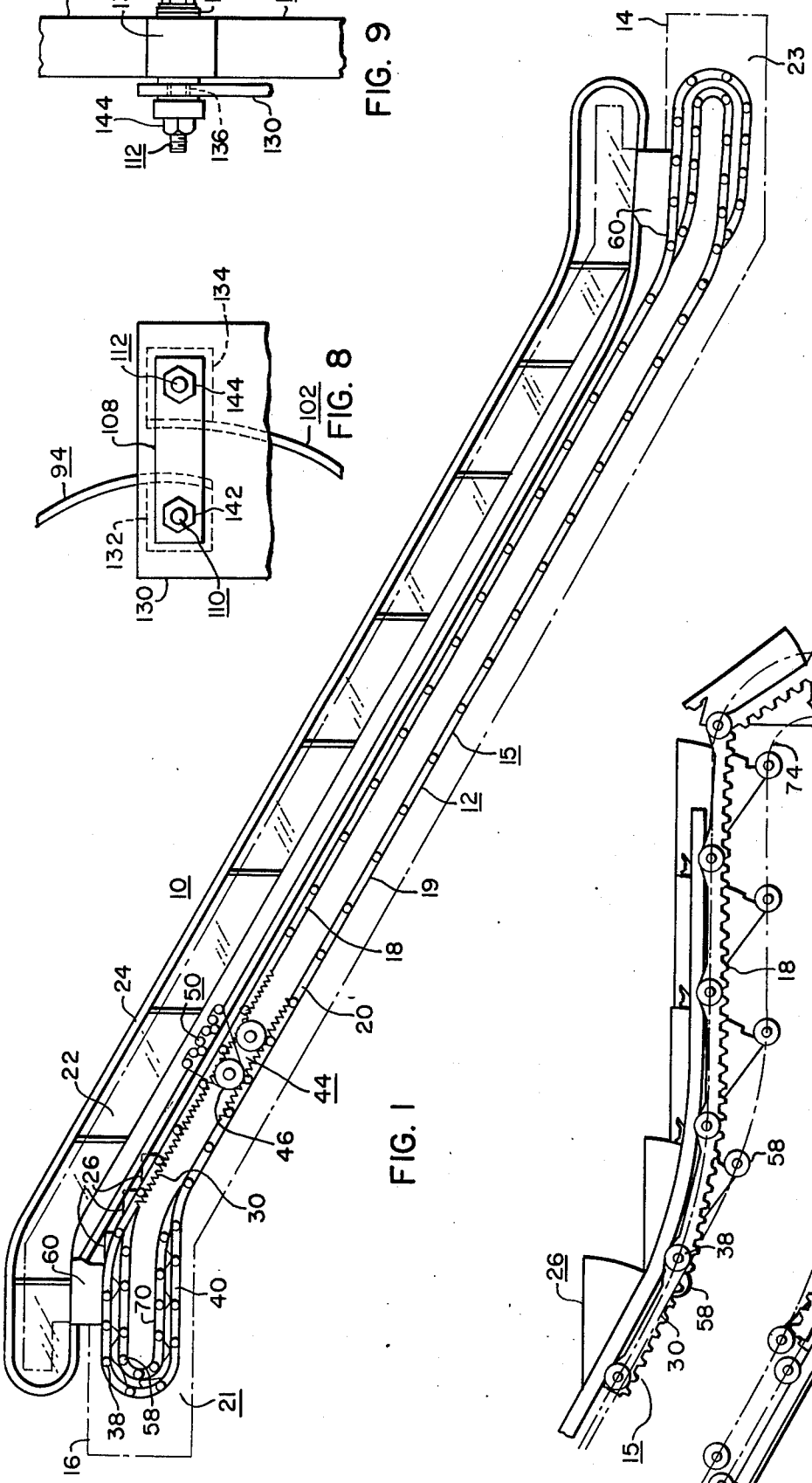
FIG. 1
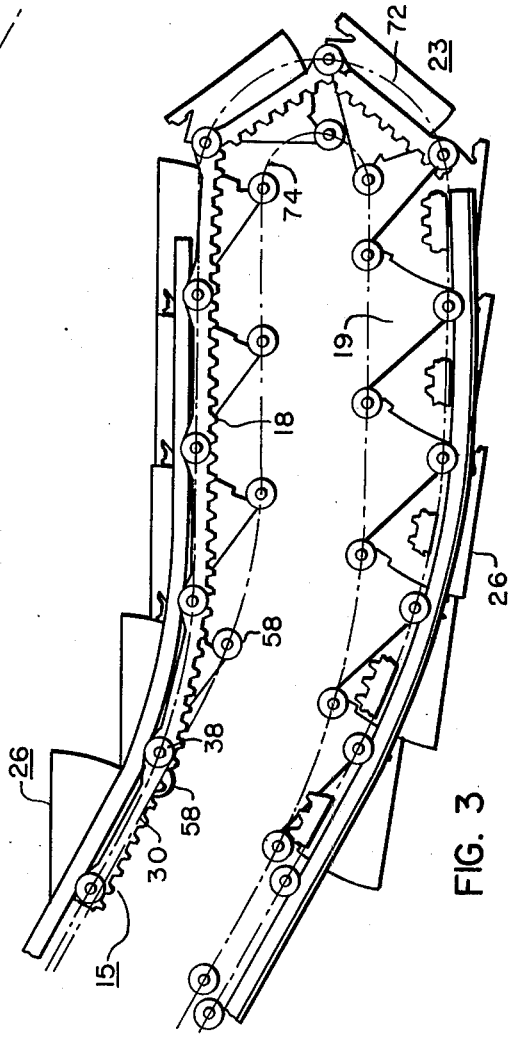
FIG. 3

TRANSPORTATION APPARATUS

BACKGROUND OF THE INVENTION

1. Field of the Invention

The invention relates in general to transportation apparatus, and more specifically to passenger conveyors such as escalators and movable walks having a plurality of steps, platforms or pallets.

2. Description of the Prior Art

U.S. Pat. Nos. 3,677,388, 3,682,289 and 3,707,220, all assigned to the same assignee as the present application, disclose new and improved passenger conveyor apparatus, such as escalators, in which the steps are pulled up the incline by a toothed step link. A modular drive unit located in the truss, between the load bearing and return runs, just below the transition between the inclined portion and the upper horizontal portion of the escalator, includes a drive chain which engages the toothed step links on both the upper load bearing run and the lower return run.

The escalator construction disclosed by the hereinbefore mentioned patents includes an endless belt having two sides, each of which are formed by pivotally interconnected, toothed step links. Step axles interconnect the two sides of the endless belt, and the steps are clamped to the step axles. The endless belt and steps are guided through the load bearing and return runs, as well as through the turn-arounds which interconnect the load bearing and return runs, by axle rollers or guide wheels on the ends of the step axles, trailer wheels on the steps, and separate guide tracks for supporting the guide wheels and the trailer wheels.

The escalator construction of the hereinbefore mentioned patents provides many advantages over escalators which utilize a step chain and a top sprocket-drive machine to pull the steps up the incline. One of the most significant advantages is the substantial reduction in load on the working parts. As the length of the rise increases, the load on the parts remains low, with additional modular drives being added to the incline as required. The rigid step links maintain a constant distance between the step axles, and tensioning devices, required with the step chain construction, are not required.

The escalator construction of the hereinbefore mentioned patents, however, requires very close tolerances to be observed during the manufacturing and assembly of the endless belt components, in order to achieve the desired operating smoothness, as well as to meet the necessary vibration and sound levels. The reasons for this have not been completely understood, as the modular drive unit, while mounted in the truss, is isolated from the toothed links via elastomeric rollers. Thus, it would be desirable to be able to manufacture the escalators disclosed in the hereinbefore mentioned patents, and achieve the desired smoothness, vibration level, and sound level, while observing manufacturing and assembly tolerances comparable to the prior art escalator construction which utilizes a step chain.

SUMMARY OF THE INVENTION

Briefly, the present invention is a new and improved passenger conveyor, such as an escalator or moving walk, which includes an endless belt constructed of toothed links which rigidly space the associated guide wheels, such as disclosed in the hereinbefore mentioned patents. The new passenger conveyor includes dynamic transition apparatus in the turn-arounds for the guide wheels as they are directed between the load bearing and return runs of the endless belt. Each dynamic transition automatically adjusts the dimensions of the guide track in the associated turn-around according to the length dimension of the toothed link passing through the turn-around at any instant. The loading on the guide tracks in the turn-arounds has been substantially reduced and the energy which is cyclically pumped into the truss is reduced accordingly. This substantially reduces the magnitude of the vibrations felt in the feet of the passengers as they are transported by the passenger conveyor, it reduces airborne noise, and it provides a very smooth ride. Most importantly, the improved performance is achieved, not through unusually tight manufacturing and assembly tolerances, but on the contrary, the new and improved passenger conveyor achieves the superior performance while enabling normal manufacturing tolerances to be observed. The dynamic transition apparatus also accommodates dimensional changes due to temperature and wear, always seeking and achieving the optimum adjustment mode.

Thus, the initial high quality performance is not degraded as the passenger conveyor is used and the bushings, step links, and other parts are subjected to normal wear. This substantially reduces maintenance cost.

BRIEF DESCRIPTION OF THE DRAWING

The invention may be better understood, and further advantages and uses thereof more readily apparent, when considered in view of the following detailed description of exemplary embodiments, taken with the accompanying drawings in which:

FIG. 1 is an elevational view of a passenger conveyor of the type which may utilize the teachings of the invention;

FIG. 3 is a fragmentary, elevational view of the lower turn-around of the passenger conveyor shown in FIG. 1, illustrating the movement of the rigid toothed links in the turn-around;

FIGS. 8 and 9 are side elevational and end elevational views, respectively, of turn-around apparatus constructed according to a preferred embodiment of the invention;

DESCRIPTION OF THE PREFERRED EMBODIMENTS

Figure 2:
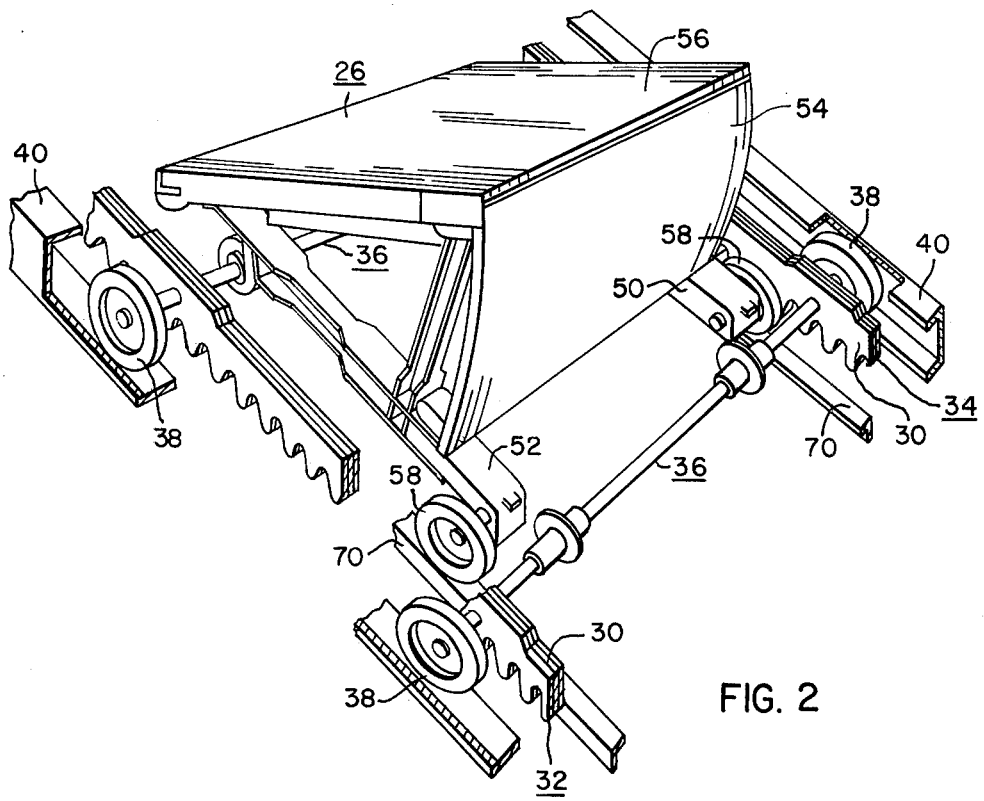
FIG. 2 is a fragmentary, perspective view of the passenger conveyor shown in FIG. 1, illustrating the guide and trailer wheels and their associated tracks.

Referring now to the drawings, and FIG. 1 in particular, there is shown transportation apparatus 10 which may utilize the teachings of the invention. While the invention is equally applicable to moving walkways having an endless series of rigid segments or platforms, commonly called pallets, it will be described relative to a movable stairway. Apparatus 10 employs a conveyor portion 12 for transporting passengers between a first landing 14 and a second landing 16. Conveyor 12 is of the endless type, having an articulated belt 15 which is driven about a closed path or loop. While the invention may be utilized with any type of movable stairway which utilizes rigid spacing of the belt supporting guide wheels, its use is particularly advantageous with the modular passenger conveyor construction disclosed in the hereinbefore mentioned U.S. patents, and the invention will be described relative to such construction.

Conveyor 12 includes an upper load bearing run 18 upon which the passengers stand while being transported between the landings 14 and 16, a lower return run 19, and upper and lower turn-arounds 21 and 23, respectively, which interconnect the load bearing and return runs.

Conveyor 12 includes a plurality of steps 26, only a few of which are shown in FIG. 1. Steps 26 move in a closed path, driven by a modular drive unit 44. The endless, flexible belt 15 has first and second sides, each of which are formed of rigid, pivotally interconnected toothed step links 30. The two sides of the belt 15 are interconnected by step axles 36, shown in FIG. 2, to which the steps 26 are connected. The belt 15 is supported by guide and support rollers or wheels 38 which cooperate with guide tracks 40. The steps 26, in addition to being supported by belt 15, are also supported and guided by trailer wheels or rollers 58 which cooperate with trailer guide tracks 70 to guide and support the steps 26 in the endless loop.

Modular drive unit 44 includes sprocket wheels and chains which engage the toothed step links 30 of the conveyor 12, to pull the load bearing run 18 of the endless belt 15 up the incline between the landings 14 and 16.

FIG. 2 is a fragmentary, perspective view of a step 26 disposed on the load bearing run 18 of the conveyor 12, with parts removed and/or broken away in order to more clearly illustrate the toothed step link type of construction, as well as the guiding means for this type of apparatus. First and second sides of the endless belt 15 form first and second closed loops 32 and 34 which are formed of the pivotally interconnected toothed step links 30. The two loops 32 and 34 are disposed in spaced, side-by-side relation, with the planes of the loops being vertically oriented. A plurality of spaced step axles 36 extends between the loops 32 and 34, transverse to the vertical planes thereof, with the ends of the step axles 30 extending through aligned openings of adjacent toothed step links 30 of the loops 32 and 34. The toothed step links 30 may be formed of stacked, metallic laminations, such that their ends dovetail, enabling openings in their ends to be aligned while also aligning the toothed step links 30 of each loop.

The main guide wheels or rollers 38 are mounted on opposite ends of each step axle 36, which rollers are guided about the closed path by the guide tracks 40. The step axles 36 have shoulders disposed thereon which axially locate the steps 26 on the step axle. The steps may be clamped to the step axles 36 as disclosed in my U.S. Pat. No. 3,798,972, which is assigned to the same assignee as the present application.

Each of the steps 26 includes right and left-hand step brackets 50 and 52, respectively, a cleated riser 54 which extends between the step brackets on one end thereof, and a treadboard 56, which also extends between the step brackets, forming the surface upon which the passengers stand. The ends of the step brackets 50 and 52 which are adjacent to the riser 54 are provided with the trailer wheels 58. The trailer wheels 58 are supported by the trailer wheel guide tracks 70.

Figure 4:
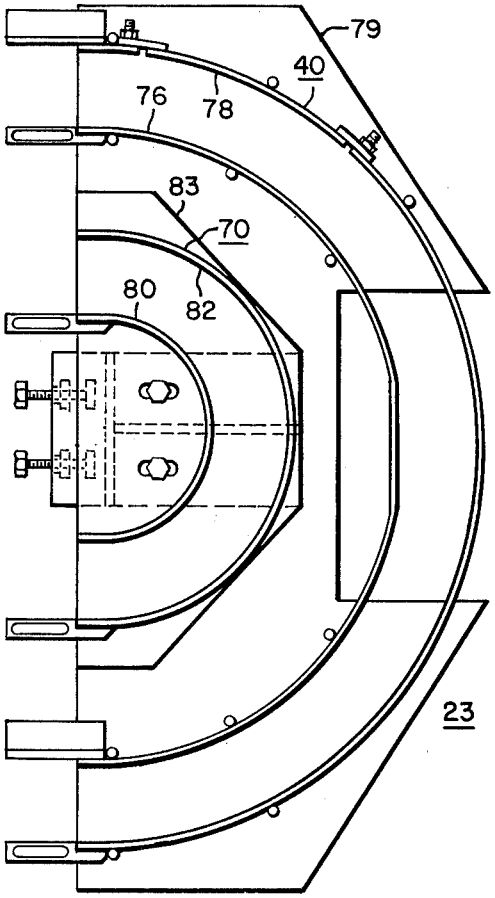
PRIOR ART FIG. 4
FIG. 4 is an elevational view of the guide track structure of a turn-around constructed according to the teachings of the prior art.

FIG. 3 is a fragmentary, elevational view of the belt 15 as it proceeds from the load bearing run 18 to the return run 19 via the lower turn-around 23. The guide wheels 38 follow the smooth curve 72 through the turn-around, while the trailer wheels 58 follow the smooth curve 74. Since the guide and trailer wheels 38 and 58, respectively, follow smooth curves through the turn-arounds, the guide and trailer tracks 40 and 70, respectively, are constructed in the prior art as illustrated in FIG. 4. FIG. 4 illustrates the lower turn-around 23, with the upper turn-around 21 being of similar construction. The guide track 40 in FIG. 4 includes inner and outer tracks 76 and 78, respectively, which are solidly attached to a vertically oriented plate member 79. The guide wheels 38 transfer from the inner track 76 to the outer track 78 as the belt 15 proceeds from the load bearing to the return run on a descending escalator. With an ascending escalator the belt 15 changes from the return run to the load bearing run in the bottom turn-around 23 and thus the guide wheels 38 in this instance would transfer from the outer track 78 to the inner track 76.

The trailer wheel track 70 includes inner and outer tracks 80 and 82, respectively, which are solidly fixed to a vertically oriented plate member 83. Plate member 83 is spaced inwardly from the plate member 79 to which the main guide wheel tracks are attached, as illustrated more clearly in FIG. 2. In a manner hereinbefore described relative to the guide wheels, the trailer wheels 58 transfer between the inner and outer tracks, depending upon the direction of stairway motion. The prior art track construction shown in FIG. 4 supports the guide and trailer wheels on one side of the endless belt, with the turn-around 23 including a structure similar to that shown in FIG. 4 for supporting the guide and trailer wheels on the other side of the endless belt.

While the prior art escalator construction shown in the hereinbefore mentioned patents provides many advantages over the prior art step chain construction, it requires the observance of extremely close manufacturing and assembly tolerances in order to assure that the escalator will operate within the vibration and sound requirements of such apparatus. I have found that the rigidly spaced guide wheels of the prior art toothed link type escalator construction do not perform in the expected manner as they negotiate the transition between the load bearing and return runs in the turn-arounds. Instead of smoothly transferring from one guide track to the other, the transfer is made abruptly with a high load on one track at one instant, and then no load on either track, and then just as abruptly a high load is applied to the other track. This type of transfer sets up a low frequency vibration in the guide wheel tracks which are solidly connected to the truss. Thus, the truss vibrates, and these vibrations are transmitted into the steps and to the feet of the passengers. Low frequency vibrations, such as 1.5 Hz. are the most objectionable, and make the ride feel rough. Attempts to reduce the magnitude of the vibrations in the truss have heretofore led to the very tight tolerances hereinbefore referred to. I have found that the magnitude of the vibrations may be reduced to an insignificantly low magnitude and that the vibration pattern may be substantially changed, to reduce the adverse effect of even the low level vibration which remains, by employing a dynamic guide track assembly in the turn-arounds which automatically adjusts the dimensions of the guide tracks according to the length of the endless belt 15 and the dimensions between the guide wheels. My new construction not only substantially improves ride quality, but it enables the improved ride quality to be achieved while utilizing normal manufacturing and assembly tolerances, substantially reducing the manufacturing cost of the apparatus as well as maintenance costs. Further, the improved ride quality does not degrade with bushing and step link wear, as the dynamic turn-arounds automatically compensate for changes in these dimensions over the life of the transportation apparatus.

Figure 5:
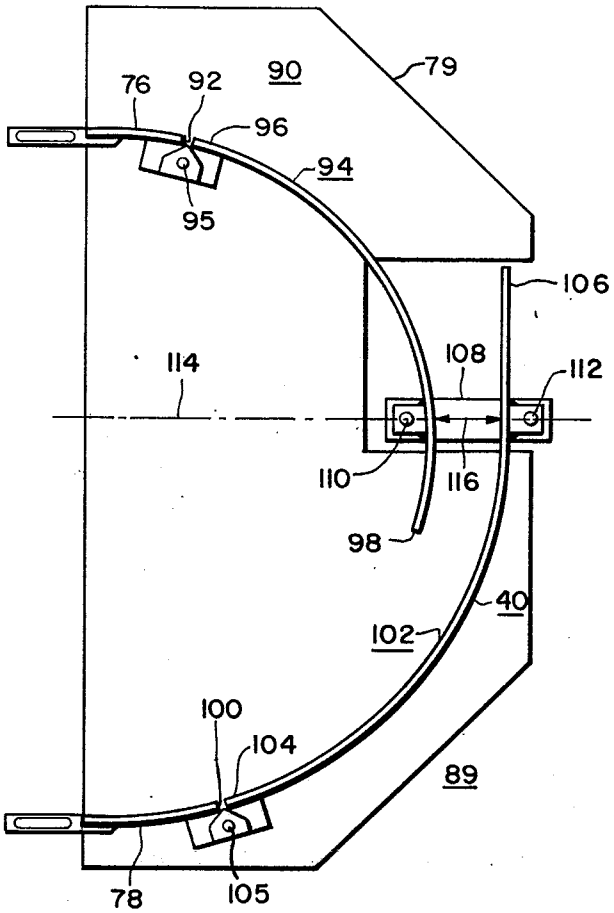
FIG. 5 is an elevational view of guide track turn-around apparatus constructed according to the teachings of the invention.

FIG. 5 is an elevational view of a turn-around 89 having dynamic transition apparatus 90 constructed according to the teachings of the invention, which may be incorporated into the upper and lower turn-arounds 21 and 23 of the transportation apparatus 10 shown in FIG. 1. Instead of solidly fixing the guide track 40 to the plate member 79, the inner track 76 is terminated at end 92, at the start of the curved portion of the guide track turn-around. A curved track member 94 having first and second ends 96 and 98, respectively, is disposed to continue the inner track 76 into the turn-around 89. The first end 96 is pivotally fixed to the stationary plate member 79 via a pivot assembly 95. End 96 of the curved member 94 which is located adjacent to end 92 of the inner track 76 allows the guide wheels to smoothly transfer between the fixed inner track 76 and the pivotally mounted curved inner track member 94.

The outer track member 78 is terminated at a point or end 100, adjacent the start of the curved outer track portion of the turn-around. A curved track member 102 having first and second ends 104 and 106, respectively, is disposed to continue the outer track 78 into the turn-around 89. The first end 104 is pivotally fixed to the stationary plate member 79 via pivot assembly 105, with its end 104 being located close to end 100 of the outer track 78 such that the guide wheels smoothly transfer between the fixed outer track 78 and the pivotally mounted curved outer track member 102.

A rigid link or lever member 108 is pivotally fixed to the inner and outer curved track members 94 and 102 via pivot assemblies 110 and 112, respectively. The pivot points of the assemblies 110 and 112 are located near the second ends 98 and 106 such that a horizontal centerline 114 through the turn-around 89 will intersect the pivot axes of the pivot assemblies 110 and 112. The minimum spacing 116 between the spaced inner and outer curved track members 94 and 102 occurs substantially along centerline 114, with this spacing 116 being selected to be equal to the diameter of the guide wheel 38 plus a nominal tolerance, such as 0.030 inch (0.76 mm).

Figure 6:
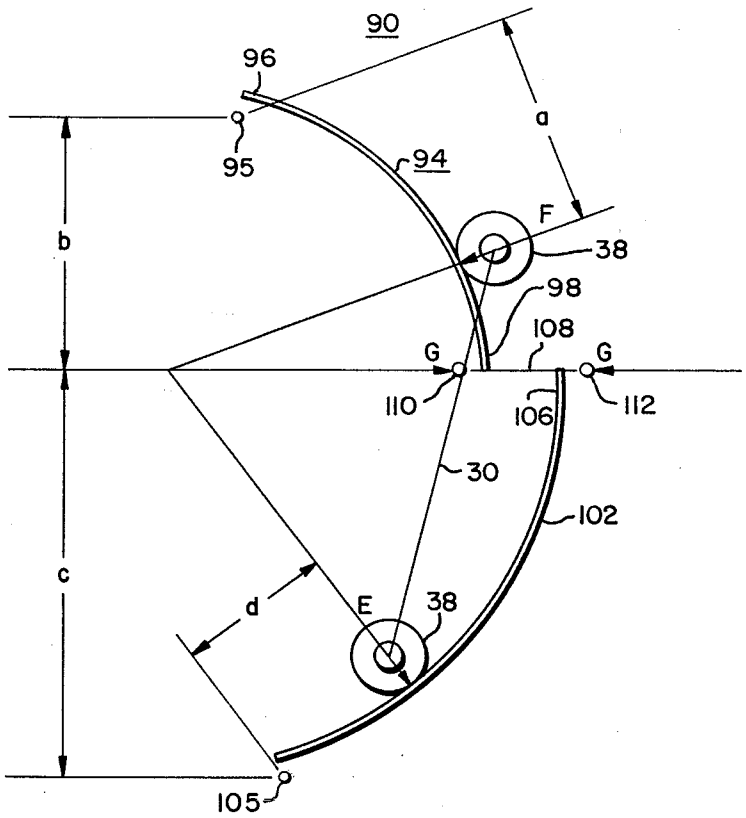
FIG. 6 schematically illustrates the operation of the turn-around apparatus shown in FIG. 5.

The dynamic transition apparatus 90 thus, in effect, includes three levers 94, 102 and 108, the operation of which may be more easily understood by referring to FIG. 6. FIG. 6 illustrates guide wheels 38 in contact with the inner and outer curved track members 94 and 102, with a step link 30 interconnecting the guide wheels 38. Important dimensions are indicated in FIG. 6 with lower case letters of the alphabet, and the forces on the guide wheels are indicated with the capital letters E and F. When the stairway is ascending, a force E on the curved outer track member 102 via guide wheel 38, such as due to the belt 15 being longer than the optimum length, due to manufacturing and assembly tolerances, wear, or both, will cause the outer curved track member 102 to rotate clockwise around the pivot axis of pivot assembly 105. The link member 108 which interconnects the two curved track members will cause the curved inner track member 94 to rotate counterclockwise about the pivot axis of pivot assembly 95, applying a force F to the next adjacent guide roller 38. When the stairway is operated in the reverse direction, i.e., descending, if the belt is longer than the desired length, the guide wheel 38 adjacent to the inner track member will leave the inner track early and the guide wheel adjacent to the outer track 102 will contact the outer track and cause it to rotate clockwise to a new position. The connecting link 108 thus causes the inner track 94 to rotate counterclockwise and cause it to move out and provide support for the guide wheel 38 which is adjacent to the curved inner track 94 at this instant. The forces on the inner and outer curved track portions 94 and 102 balance one another to provide a state of stable equilibrium, as shown in the following calculations which sum the moments about the pivot axis of assembly 95 and the moments about pivot axis 105.

The sum of the moments about the pivot axis of pivot assembly 95 are equal to:

$$Fa - Gb = 0 \text{ or } G = F(a/b)$$

The sum of the moments about the pivot axis of pivot assembly 105 are equal to:

$$Ed - Gc = 0 \text{ or } G = E(d/c)$$

Therefore, $F(a/b) = E(d/c)$

Figure 7:
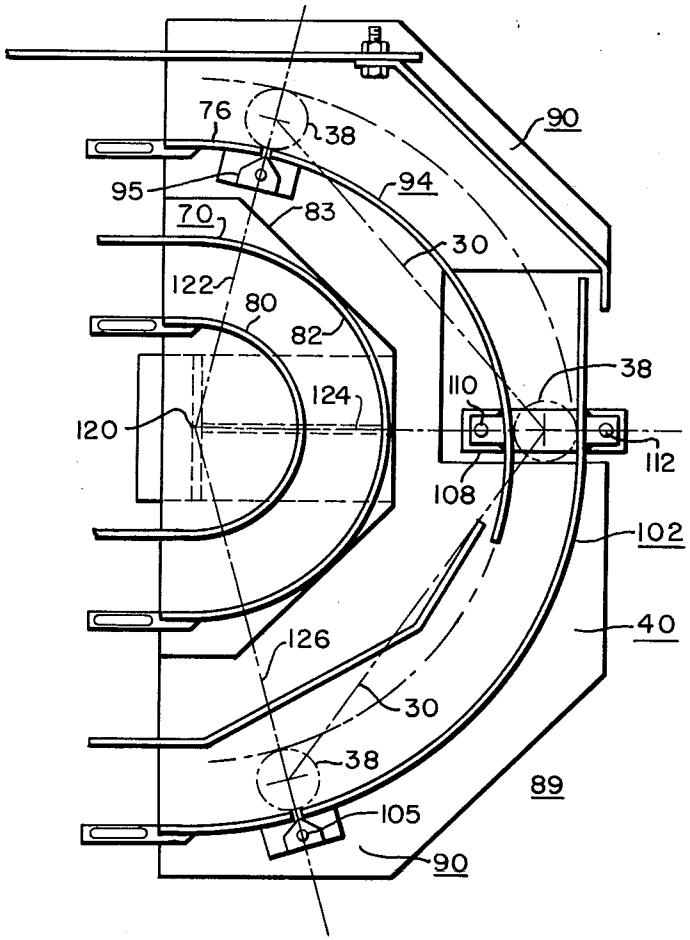
FIG. 7 is an elevational view of guide track turn-around apparatus constructed according to the teachings of the invention, which also illustrates trailer wheel tracks.

FIG. 7 is an elevational view of the turn-around 89 shown in FIG. 5, completing one side of the turn-around, including the trailer wheel guide track 70 which is horizontally spaced from the guide track 40 towards a vertical plane which divides the turn-around into two equal halves. The trailer wheel track 70 is unmodified, as the trailer wheels 58 negotiate the turn-around in the desired manner. FIG. 7 illustrates the proper relationship between the lengths of the toothed links 30 and the locations of the pivot axes. When the center of a guide roller 38 is on a line 122 drawn through the midpoint 120 of the turn-around 89 and through the pivot axis of the pivot assembly 95, the center of the next adjacent guide roller 38 should lie on a line 124 drawn through the center 120 and through the pivot axes of the pivot assemblies 110 and 112. The center of the guide wheel which is adjacent to this guide wheel should lie on a line 126 drawn through the center 120 and through the pivot axis of the pivot assembly 90. This structural relationship assures that unbalanced moments will not be developed in the curved track members of the dynamic transition assembly.

In a preferred embodiment of the invention, the link member 108 is slidably clamped to a vertically oriented plate member fixed to the truss. This preferred structure provides the essential lateral stability to the second ends 98 and 106 of the curved track members 94 and 102, respectively. FIGS. 8 and 9 are fragmentary side and end views, respectively, in elevation, of a structure which may be used.

More specifically, a plate member 130, such as a steel plate, is bolted or otherwise fastened to the truss of the passenger conveyor 10 such that its major parallel sides are vertically oriented adjacent to the second ends of the curved track members 94 and 102. Block-like members 132 and 134 are welded or otherwise secured near the second ends of the curved track members 94 and 102, with each block member having an opening therein for receiving a pivot pin. Plate 130 has spaced openings therein sized to enable the pivot pins of the pivot assemblies 110 and 112 to move through the maximum adjustment range without contacting the sides of the openings in the plate member 130. An opening 136 through plate 130 is illustrated in FIG. 9 for receiving the pivot pin of the pivot assembly 112. The pivot pins of the pivot assemblies 110 and 112 may be bolts, as illustrated, which are inserted through the blocks 132 and 134, respectively, through the relatively large openings in the plate 130 just described, such as opening 136. Suitable washer members formed of a material having relatively low coefficient of friction, such as Nylon or Teflon, are disposed about each pivot pin, one on each side of the plate member 130. The connecting link 108, which has openings sized to snugly but rotatably receive the pivot pins, is then placed over the ends of the pivot pins, and it is secured in position such as by nuts 142 and 144 which are threadably engaged with threads on the ends of the pivot pins. A spring member is disposed between each of the bolt heads of the pivot pins and the associated block, such as spring 146 which is disposed between the bolt head of one of the pivot pins and the associated block 134. The spring 146 enables the nut 144 to be tightened to the point of providing a predetermined drag on the movement of the dynamic self-adjusting turn-around assembly without restricting the desired pivotal movement of the link 108.

Figure 10:
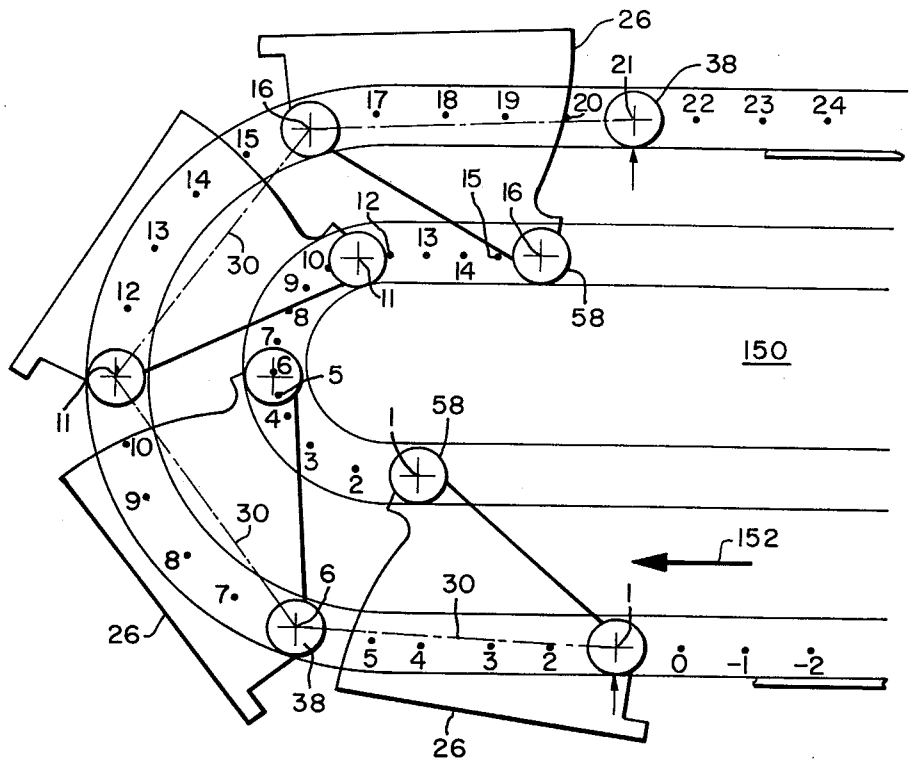
FIG. 10 is a schematic elevational view of a top turn-around illustrating various locations of the guide and trailer wheels, to be used with graphs shown in FIGS. 11 and 12.

FIG. 10 is a schematic view of a top turn-around 150 which illustrates numbered locations of the guide wheels 38 and the trailer wheels 58 as they negotiate the upper turn-around 150. This schematic illustration will be referred to when describing FIGS. 11 and 12.

Figure 11:
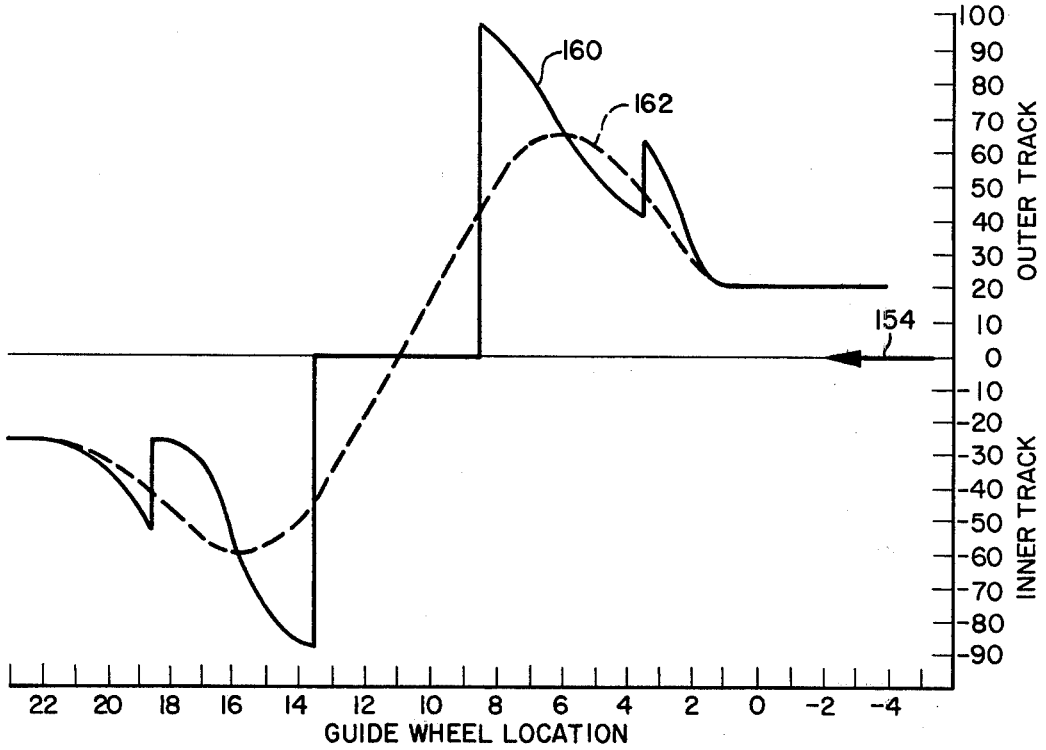
FIG. 11 is a graph comparing the guide wheel force against the associated guide track in a prior art top turn-around structure, with a dynamic top turn-around structure constructed according to the teachings of the invention.

FIG. 11 is a graph which plots the locations of the guide wheels 38 on the abscissa of the graph. The extreme right-hand side of the graph illustrates the guide wheel position as the guide wheels enter the turn-around 150 from the bottom or return run, with this direction being illustrated by arrow 152 in FIG. 10, arrow 154 in FIG. 11, and arrow 155 in FIG. 12. The guide wheels 38 continue through the turn-around 150 to the upper or load bearing run. The location of the guide wheels 38 is plotted versus the force of the guide wheels against the outer track, and the force of the guide wheels against the inner track. The force against the outer track starts from 0 and extends upwardly along the ordinate, and the force on the inner track starts from 0 and extends downwardly along the ordinate. The solid line 160 in FIG. 11 plots the guide wheel location versus force against the tracks experienced in a turn-around constructed according to the prior art structure shown in FIG. 4. The broken line 162 in FIG. 11 plots guide wheel location versus force against the guide tracks in a turn-around constructed according to the teachings of the invention, such as illustrated in FIGS. 5 and 7.

With the prior art turn-around, the force of a guide wheel 38 against the outer track increases from 20 pounds at the start of the turn-around to 96 pounds in two discrete steps. At location 8.5, the guide wheel leaves the outer track and travels through free space until it reaches position 13.5 where it engages the inner track. The guide wheel leaves the outer track abruptly, having a force on the outer track of 96 pounds at one instant and 0 at the next instant. At location 13.5 the guide wheel is in free space with zero force on the inner track at one instant and then it strikes the inner track with a force of 88 pounds at the next instant. The force on a guide wheel is maximum just before it leaves the outer track and it transfers to the inner track at its maximum force. The wheel transfers from one track to the other when the force of the wheel against the tracks is a maximum, and this transfer is made abruptly. This transfer action, being abrupt, requires an extremely precise track configuration and very critical adjustment to obtain minimum impact and acceptably smooth operation, accounting for the tight manufacturing and assembly tolerances hereinbefore referred to.

The curve 162 in FIG. 11 illustrated by the broken line illustrates the action of the guide wheels as they negotiate a dynamic turn-around constructed according to the teachings of the invention. It will be noted that the guide wheel force against the outer track increases smoothly and gradually from 20 pounds at the start of the turn-around to 65 pounds at location 6, and then it smoothly and gradually reduces to 0 at location 11 where the guide wheel transfers to the inner track with zero force. The force then gradually and smoothly increases to 60 pounds at location 16. It then smoothly reduces to 24 pounds as the step 26 emerges from the turn-around section. The maximum guide wheel force has been reduced from 96 pounds to 65 pounds and the guide wheel force increases and decreases smoothly and gradually, instead of abruptly. The transfer from the outer track to the inner track, instead of being made at maximum force, is made at zero force without impact.

Figure 12:
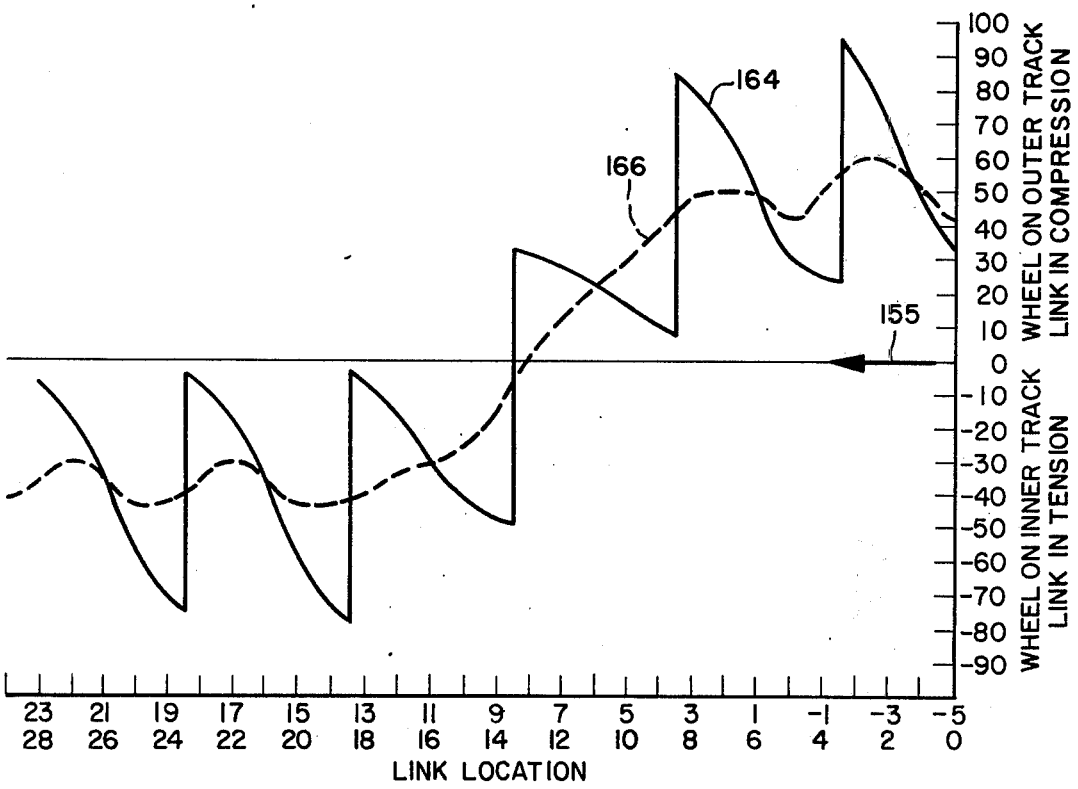
FIG. 12 is a graph comparing the step links of a prior art top turn-around structure, with a dynamic top turn-around structure constructed according to the teachings of the invention.

FIG. 12 is a graph similar in construction to the graph of FIG. 11, except step link location is plotted on the abscissa and compressive and tensile forces in the step links is plotted on the ordinate. When the guide wheel is on the outer track, the step link is in compression, with these forces starting from 0 and increasing from 0 along the ordinate in an upward direction. When the guide wheel transfers to the inner track, the step link is in tension, with the tensile forces starting from 0 and extending downwardly along the ordinate in the graph of FIG. 12. The solid line 164 illustrates the forces occurring in a toothed step link in a turn-around constructed according to the teachings of the prior art, such as the structure shown in FIG. 4, while the broken line curve 166 indicates the forces in a toothed step link in the turn-around constructed according to the teachings of the invention. It will be noted that the forces in a step link as it negotiates a prior art turn-around pulses as much as 80 pounds with a period equivalent to the travel of the length of one step. This sharp pulsing reflects the abrupt change in the guide wheel force previously described relative to FIG. 11. It will be noted that with a turn-around constructed according to the teachings of the invention, that the force smoothly changes from a compression of 50 pounds on the return run at location 2/7, gradually reducing to 0 at location 8.5/12.5, and it then gradually increases to a maximum of 40 pounds in tension on the load bearing run. Thus, the maximum compressive force on the step links has been reduced from 100 pounds to 60 pounds, and the maximum tensile force from 76 to 42 pounds. The pulsating force has been reduced to insignificantly low values, from 80 pounds to 18 pounds on the return run, and from 70 pounds to 12 pounds on the load bearing run.

Figure 13:
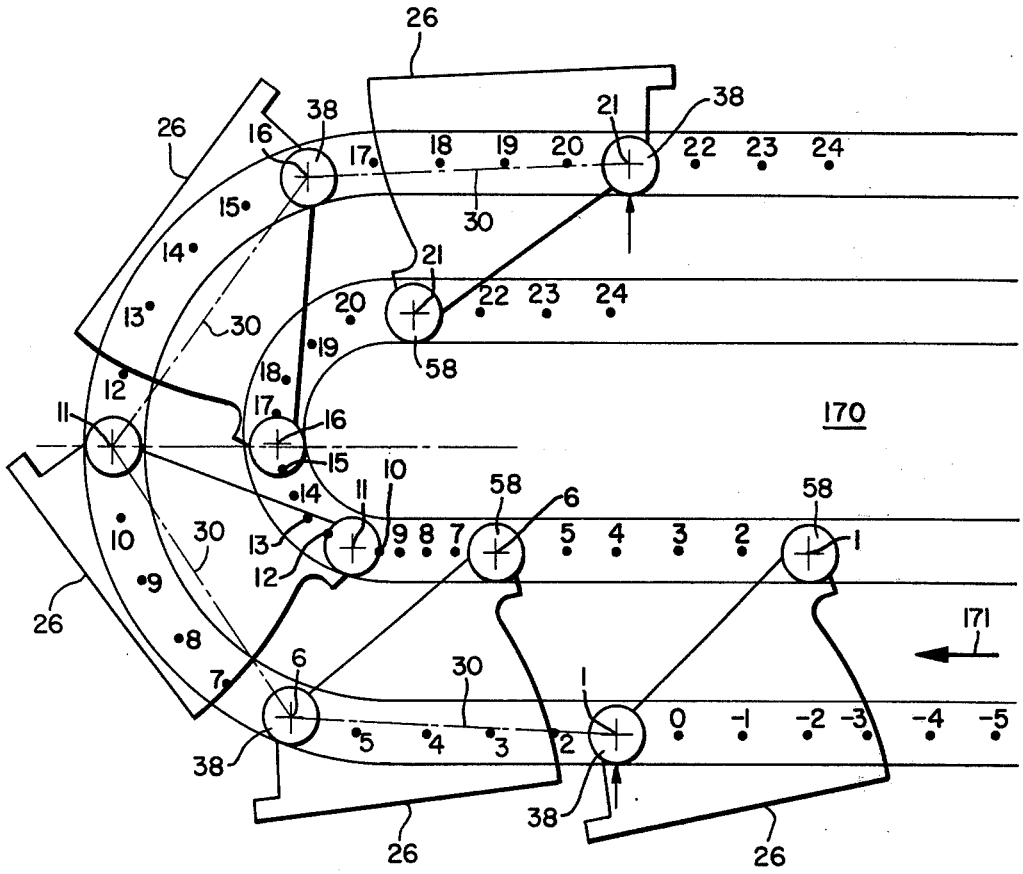
FIG. 13 is a schematic view of a bottom turn-around illustrating various locations of the guide and trailer wheels, to be used with graphs shown in FIGS. 14 and 15.
Figure 14:
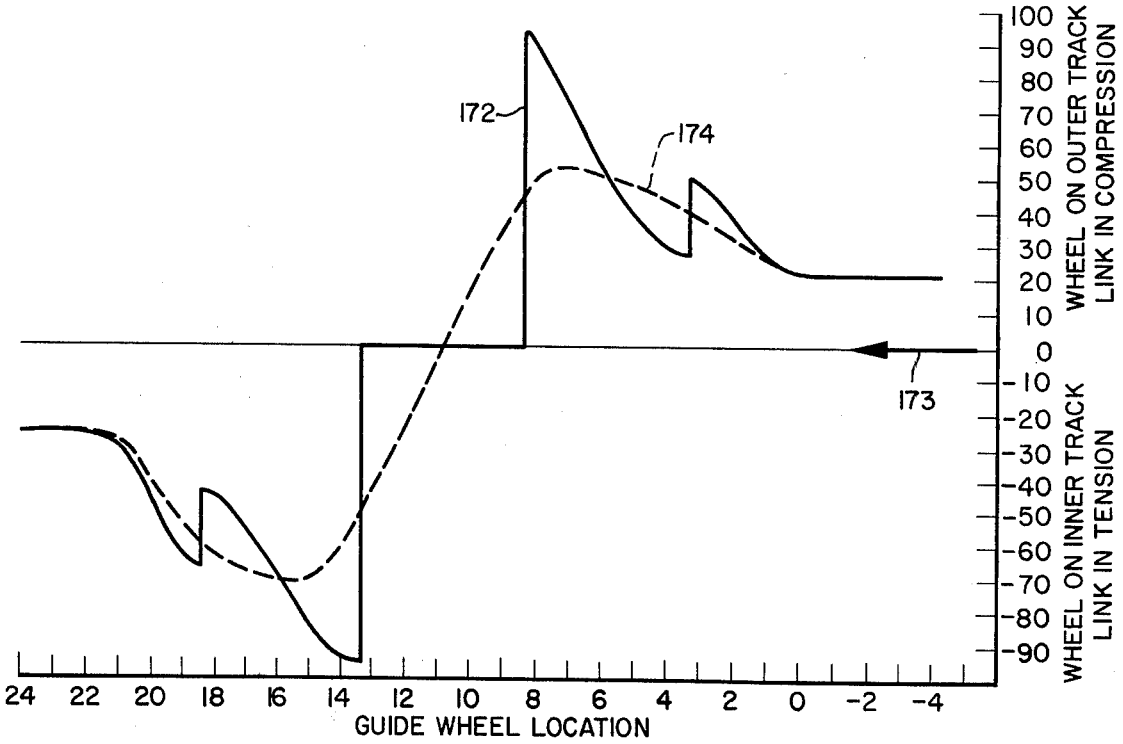
FIG. 14 is a graph comparing the guide wheel force against the associated guide tracks in a prior art bottom turn-around structure, with a dynamic bottom turn-around structure constructed according to the teachings of the invention.

Similar improvements have been achieved at the lower or bottom turn-around, with FIG. 13 schematically illustrating guide and trailer wheel locations for a bottom turn-around 170. This Figure will be referred to in describing the graphs shown in FIGS. 14 and 15.

Graph 14 plots guide wheel location on the abscissa versus the forces of the guide wheel against the outer and inner tracks on the ordinate. The solid line 172 plots the guide wheel location versus guide wheel forces for a turnaround constructed according to the teachings of the prior art, such as shown in FIG. 4. The curve 172 is very similar to the curve 160 shown in FIG. 11, increasing from about 20 pounds to about 90 pounds in two discrete steps, with 90 pounds force being exerted against the outer track at one instant, and then zero forces, and then transferring to the inner track very abruptly at a maximum force of over 90 pounds. The broken line curve 174 illustrates the action of the guide wheels of a dynamic turn-around constructed according to the teachings of the invention. The guide wheel force increases smoothly and gradually, transferring from the outer to the inner tracks at zero force, and it then increases smoothly and gradually to a maximum force of 70 pounds.

Figure 15:
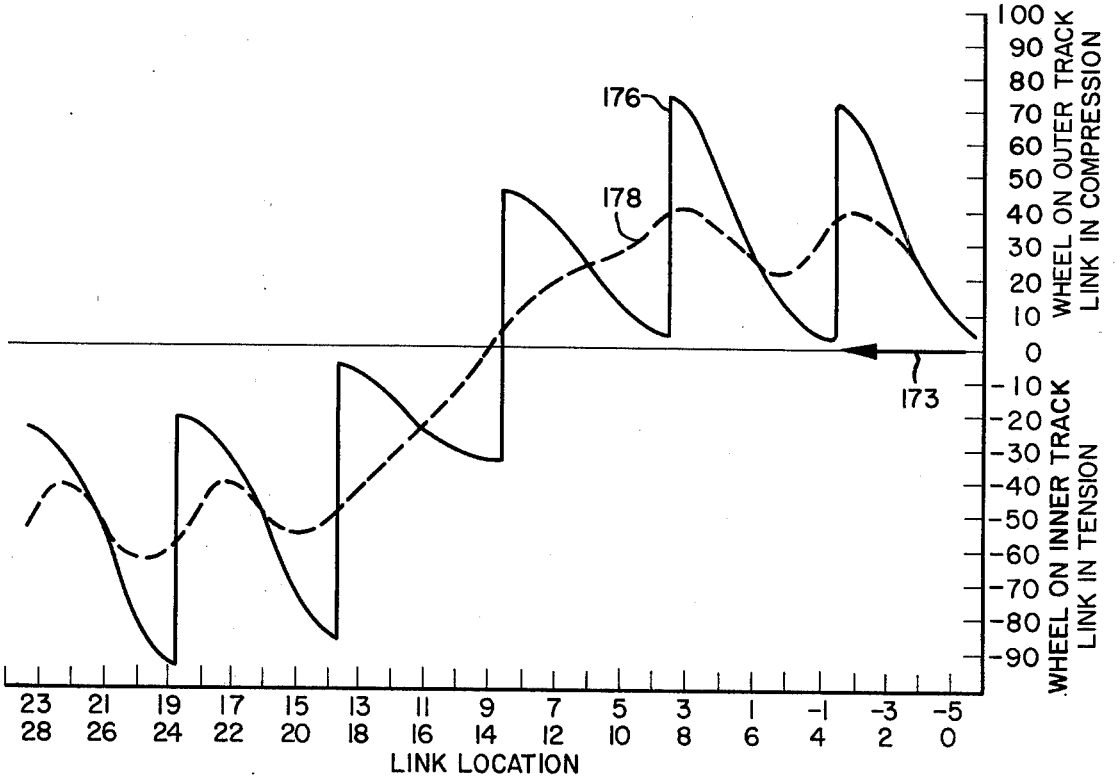
FIG. 15 is a graph comparing the forces in the step links of a prior art bottom turn-around structure, with a dynamic turn-around structure constructed according to the teachings of the invention.

The graph shown in FIG. 15 plots the location of the step link in the turn-around versus the compressive and tensile forces in the step link, with the solid curve 176 illustrating the forces on the step link in a turn-around constructed according to the prior art FIG. 4, and with the broken line curve 178 illustrating the forces in the step links for a dynamic turn-around constructed according to the teachings of the invention. The prior art curve 176 is very similar to the curve 164 shown in FIG. 12, illustrating the sharp pulsing in the step links which leads to objectionable low frequency vibrations in the associated tracks, truss, step axles, and steps. On the other hand, the forces in the step links while negotiating a turn-around constructed according to the teachings of the invention results in pulses of very low magnitude which lead to insignificant low frequency vibrations in the associated apparatus.

In summary, there has been disclosed new and improved transportation apparatus of the type which includes an articulated belt formed of rigid step links which rigidly space the steps, pallets, or platforms of the apparatus as the belt is propelled about a closed guide loop. The present invention incorporates dynamic turn-around apparatus at the ends of the loop through which the belt is guided, with the turn-around apparatus providing a transition between the load bearing and return runs of the belt which automatically seeks the best adjustment mode for the length of the belt and the spacing between the guide rollers which guide the belt in its travel path. The dynamic transition apparatus in the turn-around substantially reduces the magnitude of the forces which are pumped into the guide tracks and truss of the apparatus, it changes the magnitude of pulsations in the forces in the guide wheels and associated guide tracks, and it accomplishes these substantial reductions while enabling ordinary manufacturing and assembly tolerances to be utilized during the manufacture of the transportation apparatus. Further, the dynamic transition apparatus adjusts for dimensional changes in the articulated belt due to temperature and wear over the operating life of the transportation apparatus.

I claim as my invention:

1. Transportation apparatus, comprising:

an endless belt having first and second sides, said endless belt having a plurality pivotally of interconnected link members on each of its first and second sides, a plurality of platforms attached to said belt, means driving said belt in a loop, said loop including first and second ends which interconnect load bearing and return runs of said belt, and means supporting and guiding said belt about said loop including guide wheels and guide tracks on both sides of said endless belt, each of said guide wheels being mounted with its rotational axis coinciding with a pivot axis of two pivotally interconnected link members, said guide tracks including fixed load bearing and return run portions, and turn-around means at the ends of the loop providing a dynamic transition between said load bearing and return run portions, said turn-around means including curved load bearing and return run track portions, means pivotally mounting said curved load bearing and return run track portion adjacent to the fixed load bearing and return run track portion, respectively, translating means, and means connecting said translating means to each of said curved load bearing and return run track portions such that the movement of one curved track portion is translated to movement of the other, said guide wheels being transferred between said curved load bearing and return run track portions as said belt is driven in a loop by said driving means, with the interconnected link members defining the spacing between adjacent guide wheels on each side of the belt, said link members and guide wheels adjusting the positions of the curved track portions via said translating means to cause the forces applied by the guide wheels against the curved load bearing and return run track portions to be substantially balanced.

2. The transportation apparatus of claim 1 wherein the platforms are steps which include trailer wheels, and including guide tracks for the trailer wheels which direct the steps into a step mode during the load bearing run of the belt.

3. Transportation apparatus, comprising:

an endless belt having first and second sides, a plurality of platforms attached to said belt, means driving said belt in a loop, said loop including first and second ends which interconnect load bearing return runs of said belt, and means supporting and guiding said belt about said loop including guide wheels and guide tracks, said guide wheels being rotatably mounted in predetermined spaced relation on the first side of said endless belt, and on the second side of said endless belt, said guide tracks including load bearing and return run portions, and turn-around means at the ends of the loop providing a dynamic transition between said load bearing and return run portions, said turn-around means including movable load bearing and return run track portions, and means interconnecting said movable portions to translate the movement of one to movement of the other, said movable load bearing and return run track portions each including a fixed pivot axis and a floating pivot axis, with the dimensions between the fixed and floating pivot axes being responsive to the predetermined spaced relation of the guide wheels.

4. Transportation apparatus, comprising:

an endless belt, a plurality of platforms attached to said belt, means driving said belt and platforms in a loop, said loop including first and second ends which interconnect load bearing and return runs of said belt and platforms, and means guiding said belt about said loop including guide wheels and guide tracks, said guide tracks including load bearing and return run tracks, and means providing an automatically adjustable transition therebetween at each of the first and second ends of the loop which means defines turn-arounds for the endless belt, said means including first and second curved members having first ends oriented to provide extensions of the load bearing and return run tracks, respectively, and second ends, means pivotally mounting the first ends of said first and second curved members on first and second pivot axes, respectively, and means interconnecting the second ends of said first and second curved members to provide a predetermined fixed distance between selected points of the first and second curved members without restricting pivotal movement thereof.

5. The transportation apparatus of claim 4 wherein the guide wheels are spaced by a predetermined dimension, with the first and second pivot axes being spaced from the means which interconnect the second ends of the first and second curved members by a dimension related to said spacing between adjacent guide wheels.

6. The transportation apparatus of claim 4 wherein the belt includes first and second sides each formed of a plurality of pivotally interconnected rigid link members having a predetermined dimension between adjacent pivot axes, and a plurality of shaft members disposed to interconnect the first and second sides of the belt, with the longitudinal axis of each shaft member being coincident with a pivot axis on each side of the belt, and wherein the guide wheels are rotatably mounted on the ends of the shaft members.

7. The transportation apparatus of claim 4 wherein the means which interconnects the second ends of the first and second curved members is a floating link member pivotally mounted to each of the first and second curved members, with the pivot axes being substantially at the midpoint of the associated turn-around.

8. An escalator, comprising:

an endless belt having first and second sides, a plurality of steps attached to said belt, means for driving said belt in a loop including first and second turn-arounds which interconnect load bearing and return runs of said belt, and means guiding said belt about said loop including a plurality of guide wheels rotatably mounted on each side of said endless belt, and guide track means, said guide track means including a first track member on each side of the belt for supporting said guide wheels on the load bearing run, a second track member on each side of the belt for supporting said guide wheels on the return run, and third track means at each side of the belt in each of the first and second turn-arounds for supporting said guide wheels during the transition of the guide wheels between the first and second track members, a first curved track member having a first end adjacent to the first track member to continue the first track member into the turn-around, and a second end, a second curved track member having a first end adjacent to the second track member which continues the second track member into the turn-around, and a second end, means pivotally mounting said first ends of the first and second curved track members on first and second fixed pivot axes, respectively, a link member interconnecting the second ends of said first and second curved track members which provides and maintains a predetermined dimension between the first and second curved track members while permitting each to pivot about its fixed pivot axis.

9. The escalator of claim 8 wherein the linking member spaces the second ends of the curved track members by a dimension selected to accept the diameter of the guide wheels.

10. The escalator of claim 8 herein each side of the endless belt includes pivotally interconnected rigid link members, step axles interconnecting the link members on each side of the belt, and wherein the guide wheels are mounted on the ends of the step axles.

* * * * *